US009502785B2

(12) United States Patent
Schmidt et al.

(10) Patent No.: US 9,502,785 B2
(45) Date of Patent: Nov. 22, 2016

(54) ELECTRICAL TERMINAL FOR TERMINATING A WIRE

(71) Applicant: Tyco Electronics AMP GmbH, Bensheim (DE)

(72) Inventors: Helge Schmidt, Speyer (DE); Alexandre Rosi, Paris (FR); Xavier Rouillard, Franconville (FR); Jean Pierre Picaud, Eaubonne (FR); Carlos Salgado, Eaubonne (FR); Tehuai Chin, Clichy (FR); Uwe Bluemmel, Hemsbach (DE)

(73) Assignees: TE Connectivity Germany GmbH, Bensheim (DE); Tyco Electronics France SAS, Pontoise (FR)

( * ) Notice: Subject to any disclaimer, the term of this patent is extended or adjusted under 35 U.S.C. 154(b) by 0 days.

(21) Appl. No.: 14/643,406

(22) Filed: Mar. 10, 2015

(65) Prior Publication Data

US 2015/0255886 A1 Sep. 10, 2015

(30) Foreign Application Priority Data

Mar. 10, 2014 (EP) ..... 14290059

(51) Int. Cl.

| | |
|---|---|
| ***H01R 11/22*** | (2006.01) |
| ***H01R 4/18*** | (2006.01) |
| ***H01R 43/048*** | (2006.01) |
| *H01R 4/62* | (2006.01) |
| *H01R 13/52* | (2006.01) |
| *H01R 43/00* | (2006.01) |

(52) U.S. Cl.

CPC ..... *H01R 4/183* (2013.01); *H01R 4/185* (2013.01); *H01R 43/048* (2013.01); *H01R 4/188* (2013.01); *H01R 4/62* (2013.01); *H01R 13/5216* (2013.01); *H01R 43/005* (2013.01)

(58) Field of Classification Search

CPC .. H01R 13/187; H01R 23/727; H01R 13/20; H01R 13/15; H01R 13/115; H01R 13/113; H01R 4/185

USPC ..... 439/843–847, 850–852, 877

See application file for complete search history.

(56) References Cited

U.S. PATENT DOCUMENTS

| | | | | |
|---|---|---|---|---|
| 4,641,911 A | | 2/1987 | Pavlak et al. | |
| 5,519,170 A | * | 5/1996 | Nabeshima | H01R 13/5205 174/74 R |
| 5,624,273 A | * | 4/1997 | Myer | H01R 4/2466 439/399 |
| 6,206,738 B1 | * | 3/2001 | Sugie | H01R 13/057 439/852 |
| 7,121,903 B2 | * | 10/2006 | Sakaguchi | H01R 4/185 439/877 |
| 7,285,013 B1 | * | 10/2007 | Tabata | H01R 4/185 439/587 |

(Continued)

FOREIGN PATENT DOCUMENTS

WO 2012054072 A1 4/2012

*Primary Examiner* — Thanh Tam Le

(74) *Attorney, Agent, or Firm* — Barley Snyder

(57) ABSTRACT

An electrical terminal is disclosed having a crimp barrel. The crimp barrel has a base; and opposing side walls extending from the base and each has an opposing end region. The opposing side walls have a conductor receiving region in which the sidewalls have an F-crimp when crimped to stripped conductors of a wire; a wire insulation receiving region for receiving an insulation covered portion of the wire; and a transition region positioned between the conductor receiving region, and the wire insulation receiving region. The opposing end regions in the transition region are overlapped in the circumferential direction when crimped to surround the wire.

13 Claims, 4 Drawing Sheets

(56) References Cited

U.S. PATENT DOCUMENTS 7,306,495 B2 * 12/2007 Hashimoto ..... H01R 4/185 439/877
7,347,747 B2 * 3/2008 Shimizu ..... H01R 13/11 439/842
7,811,140 B2 * 10/2010 Tabata ..... H01R 4/185 439/877
7,828,611 B2 * 11/2010 Nakamura ..... H01R 4/185 439/877
7,828,612 B2 * 11/2010 Kumakura ..... H01R 4/185 439/877
8,167,666 B2 * 5/2012 Koga ..... H01R 4/185 439/595
8,828,611 B2 * 9/2014 Yoon ..... H01M 10/052 252/62.2
8,858,274 B2 * 10/2014 Jakoplic ..... H01R 13/11 439/843
8,870,611 B2 * 10/2014 Sato ..... H01R 4/188 439/442
9,039,467 B2 * 5/2015 Seipel ..... H01R 4/185 439/877
9,130,282 B2 * 9/2015 Suzuki ..... H01R 4/185

* cited by examiner

ELECTRICAL TERMINAL FOR TERMINATING A WIRE

CROSS-REFERENCE TO RELATED APPLICATIONS

This application claims the benefit of the filing date under 35 U.S.C. §119(a)-(d) of European Patent Application No. 14 290 059.6, filed Mar. 10, 2014.

FIELD OF THE INVENTION

The invention generally relates to an electrical connector terminal, and, more specifically, to an electrical connector terminal having a crimp barrel.

BACKGROUND

Crimped electrical connector terminals are conventionally known, and often fabricated using the same conducting material for the crimp barrel and the conductors of the wire. Commonly, the conducting material is copper, due to its good electrical conductivity and mechanical strength. However, copper has nevertheless some drawbacks. Firstly, the price for copper has risen sharply in recent years. Secondly, copper is relatively dense, making it a heavy material. There is an increased industrial effort to both reduce the cost, and the weight of automobiles. Such efforts would benefit greatly by exchanging the rather heavy copper with more lightweight materials.

Given aluminium's good electrical conductivity, in combination with light weight and low cost, aluminium has been identified as a suitable material to reduce the use of copper conductors. It has long been proposed to produce electrical terminals with aluminium conductors that are crimped to a copper connector. Such a combination would thereby combine the light weight of aluminium conductors with the good spring characteristics of copper. However, the use of aluminium in combination with copper is challenging. In the presence of moisture, a difference in potential between copper and aluminium will result in the dissolution of aluminium at the points of contact between aluminium and copper, thereby negatively effecting the electrical connection between the two materials. To overcome this problem, measures have to be taken to prevent the presence of moisture in the contact area.

One such approach is disclosed in International Patent Publication No. WO 2012/054072, which discloses an electrical terminal using a copper-aluminium combination. The electrical terminal uses an F-crimp that extends from the stripped conductors of the wire up until a segment of the wire where the conductors are surrounded with an insulation layer. The crimp barrel has a front sealing portion for closing gaps at the extremity of the stripped conductor. Thus, moisture may be prevented from reaching the contact between the aluminium conductor and the copper crimp barrel. However, such a design presents sever disadvantages.

First, since the additional front seal segment is also crimped with an F-crimp, just like the other segments of the crimp barrel, the entire electrical terminal is longer in length than conventional terminals using only copper for both the wire and the crimp barrel. The extra length may result in an incompatibility with existing copper-based cable harnesses having copper terminals, when the copper-based cable harnesses are exchanged with an aluminium cable harness having the copper-aluminium terminals.

Furthermore, due to the lower conductivity of the aluminium with respect to copper, the diameter of the conductors of an aluminium wire has to be larger than the diameter of an equivalent copper wire. To avoid increasing the total diameter of the wire, the thickness of the insulation layer is typically made smaller. This, however, leads to an increased risk of moisture penetrating to the contact areas in regions where the insulation layer around the conductors is accidently cut during the crimping process. Thus, there is a higher risk that the aluminium conductors may become exposed to moisture in contact areas with copper, negatively effecting the lifetime of the connector.

In another approach, detailed in U.S. Pat. No. 4,641,911, an electrical terminal has a crimp barrel positioned such that both the stripped conductors and the insulation is crimped. A funnel shape is formed in the axial direction by partially overlapping the sidewalls of the crimp barrel. However, the crimp barrel is not suited for copper-aluminium connectors, as in the transition region between the stripped conductors and the insulation layer of the wire, the crimp barrel is not closed so that moisture can easily penetrate to the contact area.

Therefore, there is a need for an electrical terminal with an improved crimp barrel to reduce the risk of exposure of the contact area to moisture, where the electrical terminal has a reduced length so as to be compatible with conventional copper-based electrical terminals.

SUMMARY

An electrical terminal has a crimp barrel. The crimp barrel has a base; and opposing side walls extending from the base and each has an opposing end region. The opposing side walls have a conductor receiving region in which the sidewalls have an F-crimp when crimped to stripped conductors of a wire; a wire insulation receiving region for receiving an insulation covered portion of the wire; and a transition region positioned between the conductor receiving region, and the wire insulation receiving region. The opposing end regions in the transition region are overlapped in the circumferential direction when crimped to surround the wire.

BRIEF DESCRIPTION OF THE DRAWINGS

The invention will now be described by way of example, with reference to the accompanying Figures, of which.

DETAILED DESCRIPTION OF THE EMBODIMENT(S)

Figure 1:
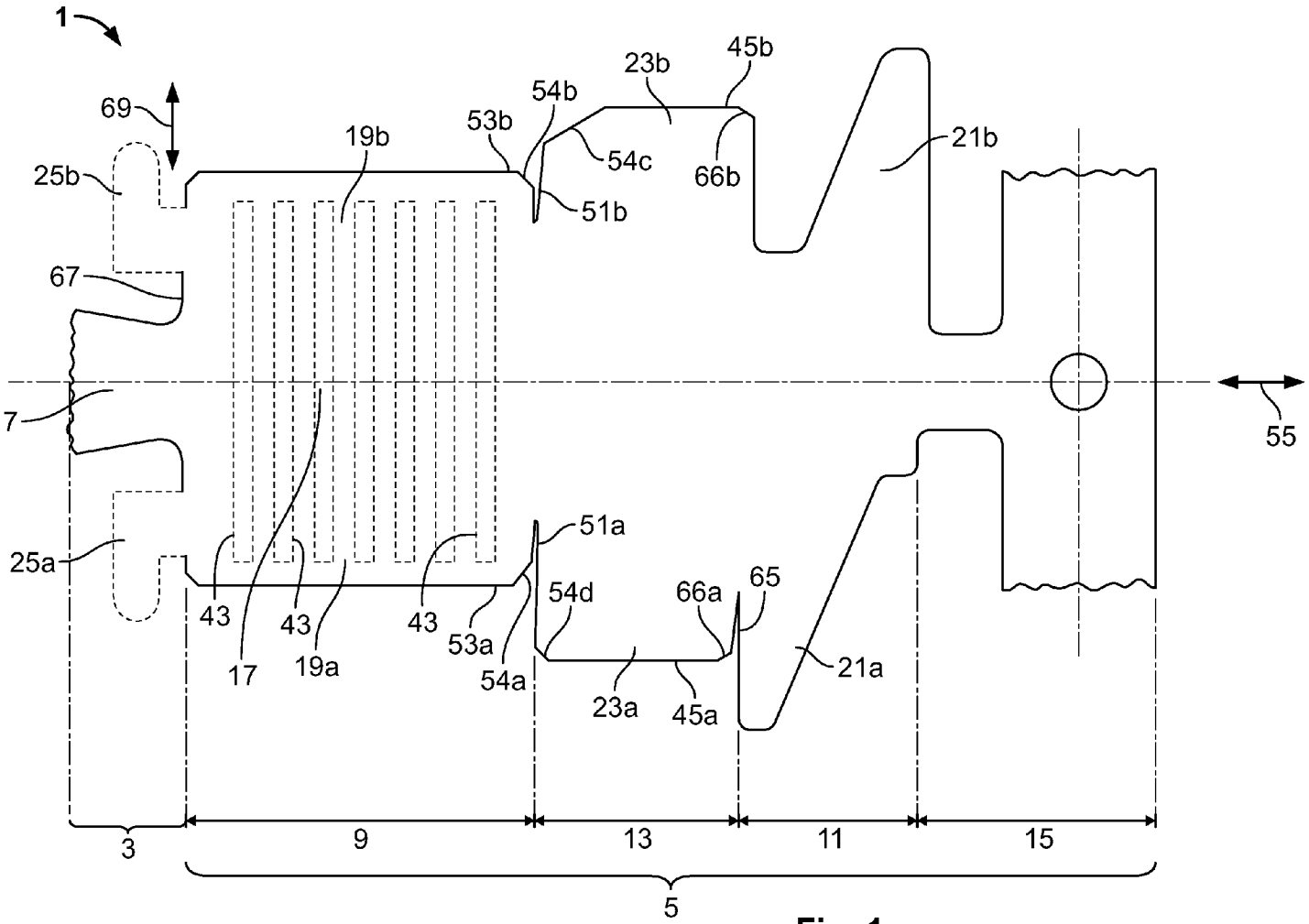
FIG. 1 is a plan view of an electrical terminal before a start of a crimping process.

In a first embodiment, shown in FIG. 1, an electrical terminal 1 has a contacting portion 3 and an adjacent crimping portion 5. The contacting portion 3 comprises an electrical contact 7 which can be of any shape and that is configured to receive a mating contact. Thus, the electrical contact 7 can be any one of a male or female contact of various shapes. Exemplary embodiments of the contact 7 may include spring contacts, beam contacts with or without fasteners such threads or mechanical fasteners, or other common electrical contacts.

The crimping portion 5 has a conductor receiving region 9 for receiving stripped conductors of a wire and a wire insulation receiving region 11 for receiving a wire part with insulation. The crimping portion 5 furthermore includes a transition region 13 between the conductor receiving region 9 and the wire insulation receiving region 11.

At the extremity opposite to the contacting portion 3, the electrical terminal 1 has an electrical pin or socket contact element in a terminating region 15.

When folded around a wire, the regions 9, 11, 13 of the crimping portion 5 form the crimp barrel.

The crimping portion 5 has a continuous base 17 that extends longitudinally from the contacting portion 3 to the terminating region 15. The conductor receiving region 9 has opposing sidewalls 19*a* and 19*b* extending from the base 17. The wire insulation receiving region 11 has opposing sidewalls 21*a* and 21*b* extending from the base 17. The transition region 13 has opposing sidewalls 23*a* and 23*b* extending from the base 17.

The sidewalls 19*a*, 19*b* of the conductor receiving region 7 each have a front cover end 25*a* and 25*b* at their extremity towards the contacting portion 3.

Figure 2A:
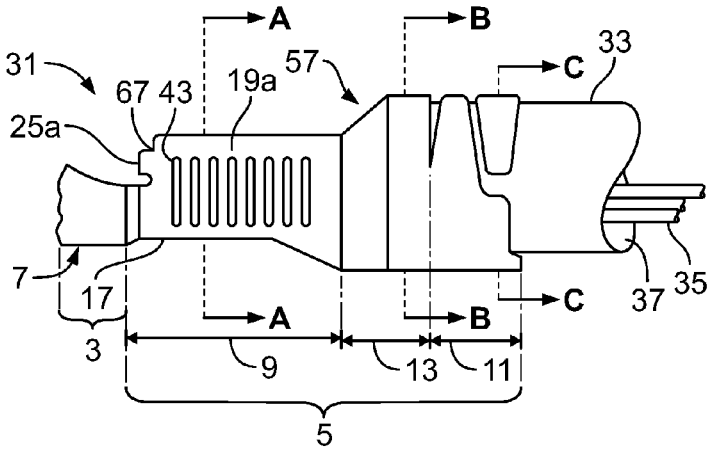
FIG. 2*a* is a perspective view of a side of the electrical terminal having a wire in the crimped state.
Figure 2B:
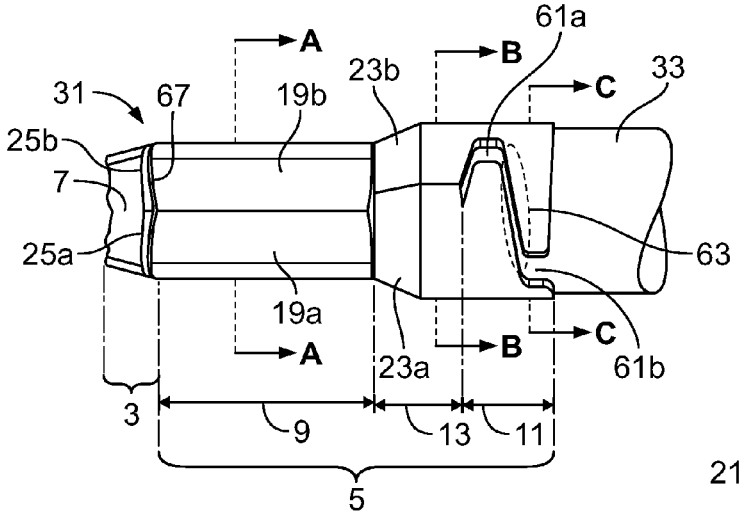
FIG. 2*b* is a perspective top view of the electrical terminal of FIG. 2*a;*

In the embodiments of FIGS. 2*a* and 2*b*, an electrical connector 31 has the crimping portion 5 crimped around a wire 33 to mechanically and electrically connect the wire 33 via the crimp barrel with the electrical contact 7 at the contacting portion 3. The electrical wire 33 includes conductors 35 and electrical insulation 37 positioned around the conductors 35. The electrical terminal 1 is particularly advantageous for connectors 31 in which wires 33 with aluminium conductors 35 are crimped to a copper electrical terminal 1. The crimp extends from the bare conductors 35 in the conductor receiving region 9, up to the wire insulation receiving region 11 where the insulation 37 is present. Thus, mechanical strength is provided where needed, in particular pull strength, even when aluminium is used as conductor material.

Figure 3A:
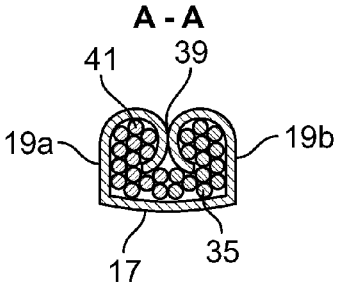
FIG. 3*a* is a sectional view of a conductor receiving region of the electrical terminal.
Figure 3B:
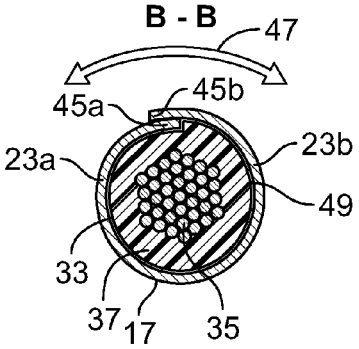
FIG. 3*b* is a sectional view of a transition region of the electrical terminal.
Figure 3C:
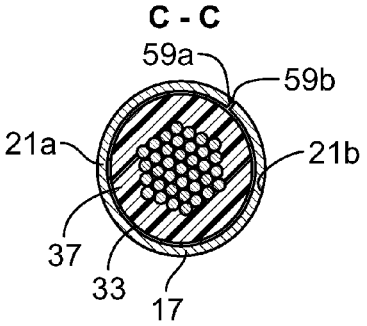
FIG. 3*c* is a sectional view of a wire insulation receiving region of the electrical terminal.

The sidewalls of the conductor receiving region 9, the transition region 13 and the wire insulation receiving region 11 are folded around the wire 33 during the crimp process, as shown in FIGS. 3*a* to 3*c*, represented by the cross-sectional views identified with the capital letters A, B and C in FIGS. 2*a* and 2*b*.

As shown in an embodiment of FIG. 3*a*, the sidewalls 19*a* and 19*b* of the conductor receiving region 9 extend from the base 17 in approximately the same direction, and are bent towards each other to at least partially extend around the conductors 35 from which the insulation 7 (as shown in FIG. 2*a*) has been stripped off. By doing so the electrical and mechanical contact to the conductors 35 is achieved. In the cross-sectional view of FIG. 3*a*, the base 17 and the folded sidewalls 19*a*, 19*b* together form a B-shape or a so-called F-crimp. In this embodiment, the conductors 35 fill a complete volume 41 therein, however, in other embodiments, some voids may be present. The sidewalls 19*a* and 19*b* contact each other in a contacting area 39, thereby closing the volume 41 defined by the sidewalls 19*a*, 19*b* and the base 17, towards the exterior environment.

As can be seen in FIG. 3*a*, together with FIGS. 2*a* and 2*b*, the conductor receiving region 9 provides electrical contact between the conductors 35 and the electrical terminal 1.

In another embodiment having aluminium conductors 35 and the copper crimping portion 5, the conductor receiving region 9 includes one or more serrations 43 (in dotted lines in FIG. 1). In an embodiment, the serrations 43 have sharp edges. The serrations 43 are used to cut into the surface of the conductors 35 to remove any non-conducting surface oxide layers that may be present or that may form at the moment of removing the insulation from the wire. The serrations 43 therefore ensure that, even in the presence of such oxide layers, reliable electrical contact is achieved between the copper of the crimping portion 5 and the aluminium of the conductors 35.

As an alternative or in addition to the serrations 43, the non-conducting surface layers on the surface of the aluminium conductors 35 can also be cracked using a higher level of compression during crimping compared to a copper-copper crimp.

In an embodiment of FIG. 3*b* showing a cross-sectional view of the transition region 13, the wire 33 is positioned on the crimping portion 5, such that the transition from a region with bare stripped conductors 35 to that a region of the wire with the insulation 37 positioned around the conductors 35 is in the transition region 13.

As seen in the embodiment of FIG. 3*b*, an area where the conductors 35 are surrounded by the insulation 37 no longer shows a B shape of an F-crimp like in FIG. 3*a*, but now the sidewalls 23*a* and 23*b* are folded around insulation 37 such that they overlap with their end region 45*a* and 45*b* along the circumferential direction 47. The base 17 and the sidewalls 23*a* and 23*b* form a confined volume 49 around the wire 33. By wrapping the sidewalls 23*a* and 23*b* around the wire without forming the B shape, any damage to the insulation 37 which otherwise could accidentally occur when using an F-crimp, can be prevented. This also means that an unwanted exposure of conductors 35 to exterior environment outside of the crimp barrel, which could lead to the intrusion of moisture between the conductors 35 and the sidewalls 23*a* and 23*b*, is prevented. Therefore, the risk of corrosion and dissolution of the aluminium in the presence of moisture can be reduced for the copper-aluminium crimp.

In an embodiment of FIGS. 2*a* and 2*b*, the intersection between the conductor receiving region 9 and the transition region 13 has a tunnel-like shape. The tunnel is formed by the sidewalls 19*a* and 19*b* of the conductor receiving region 9 and the sidewalls 23*a* and 23*b* of the transition region, together are positioned and arranged with each other such that the crimp barrel forms the tunnel with a confined volume. Thus, the risk of an exposure to moisture is further reduced.

In an embodiment shown in FIG. 1, to form the F-crimp in the conductor receiving region 9 and the overlapping crimp in the transition region 13 immediately adjacent to each other, cuts 51*a* and 51*b* or narrow slits are positioned substantially perpendicular to the edges 53*a* and 53*b* of the sidewalls 19*a* and 19*b*. In this embodiment, the cuts 51*a* and 51*b* are present on both sides, however, in other embodiments only one of the cuts 51*a*, 51*b* may be present on one side. Furthermore, bevelled or rounded edges 54*a*, 54*b*, 54*c*, 54*d* are provided at the side walls 19*a*,19*b* and 23*a*,23*b* in the transition between the conductor receiving region 9 to the transition region 13. The edges 54*a*,54*b*,54*c*,54*d* facilitate the overlapping of sidewalls 23*a*/23*b* during the crimping process, and the formation of the tapered funnel-shape 57. The shapes of these edges 54*a*,54*b*,54*c*,54*d* can vary, depending on the desired final shape.

The dimensions of the sidewalls 23*a* and 23*b* and the length of the cuts 51*a* and 51*b* are chosen such that a funnel shape 57 is obtained in the transition region 13 along the longitudinal axis 55. A smaller diameter of the funnel 57 corresponds to the diameter of the bare stripped conductors 35 and a larger diameter of the funnel 57 corresponds to the wire 33 and its insulation 37.

In an embodiment of FIG. 3*c*, a cross-sectional view along C-C in the wire insulation receiving region 11 is shown where the sidewalls 21*a* and 21*b* extend circumferentially together with the base 17 to enclose the wire 33 with its insulation 37. However, contrary to the overlapping end regions 59*a* and 59*b* in the transition region 13 in FIG. 3B, the sidewalls 21*a* and 21*b* are not overlapping. Thus, the sidewalls 21*a*,21*b* and the base 17 form a approximate ring around the wire 33. The ring may be slightly open between the opposing end regions 59*a*,59*b* of the sidewalls 21*a*,21*b*, thus presenting inspection holes 61*a* and 61*b* as shown in FIG. 2*b*. The inspection holes 61*a*,61*b* can be used to verify that the insulation 37 is present in the wire insulation receiving region 11 to prevent a false alignment of the wire 33 in the electrical terminal 1. In an embodiment of FIG. 3*c*, the sidewalls 21*a* and 21*b* of the wire insulation receiving region are circumferentially folded around the wire 33 such that the end regions 59*a* and 59*b* contact each other.

In an embodiment of FIGS. 1 and 2*b*, the sidewalls 21*a* and 21*b* of the wire insulation receiving region 11 have an approximate triangular shape, being dimensioned and positioned with respect to each other such that a joining region 63 extends at least partially over the circumference of the wire 33, thereby improving the stability of the crimp connection. One of ordinary skill in the art would appreciate that the shape of the sidewalls 21*a*, 21*b* may have other other suitable shapes to allow a ring-shaped envelope around the wire 33.

At the interface between the transition region 13 with the overlapping end regions 45*a*,45*b* and the wire insulation receiving region 11, a cut 65 is present in the end region 45*a* of the sidewall 23*a*. The cut 65 extends substantially perpendicular to the edge of the end region 45*a* and enables the transition from the overlapping crimp to the ring shaped crimp. Additionally, the sidewalls 23*a*,23*b* have bevelled or rounded edges 66*a*,66*b* to facilitate the overlapping. The shapes of these bevelled edges can vary depending on the desired final shape.

In an embodiment of FIGS. 2*a* and 2*b*, the front cover ends 25*a* and 25*b* are bent such that in the crimped state, the opening at the extremity 67 of the tunnel, defined by the base 17 and the sidewalls 19*a* and 19*b*, is also closed to seal the interior of the tunnel from the environment and to prevent the entry of moisture.

In order to keep the total length of the connector 1 comparable to a conventional copper crimp connector, the front cover ends 25*a* and 25*b* are bent around an axis 69 perpendicular to the longitudinal axis 55, such that the sidewalls 19*a*, 19*b*, 21*a*, 21*b*, 23*a* and 23*b* are all bent circumferentially around the direction parallel to the longitudinal axis 55.

Figure 4:
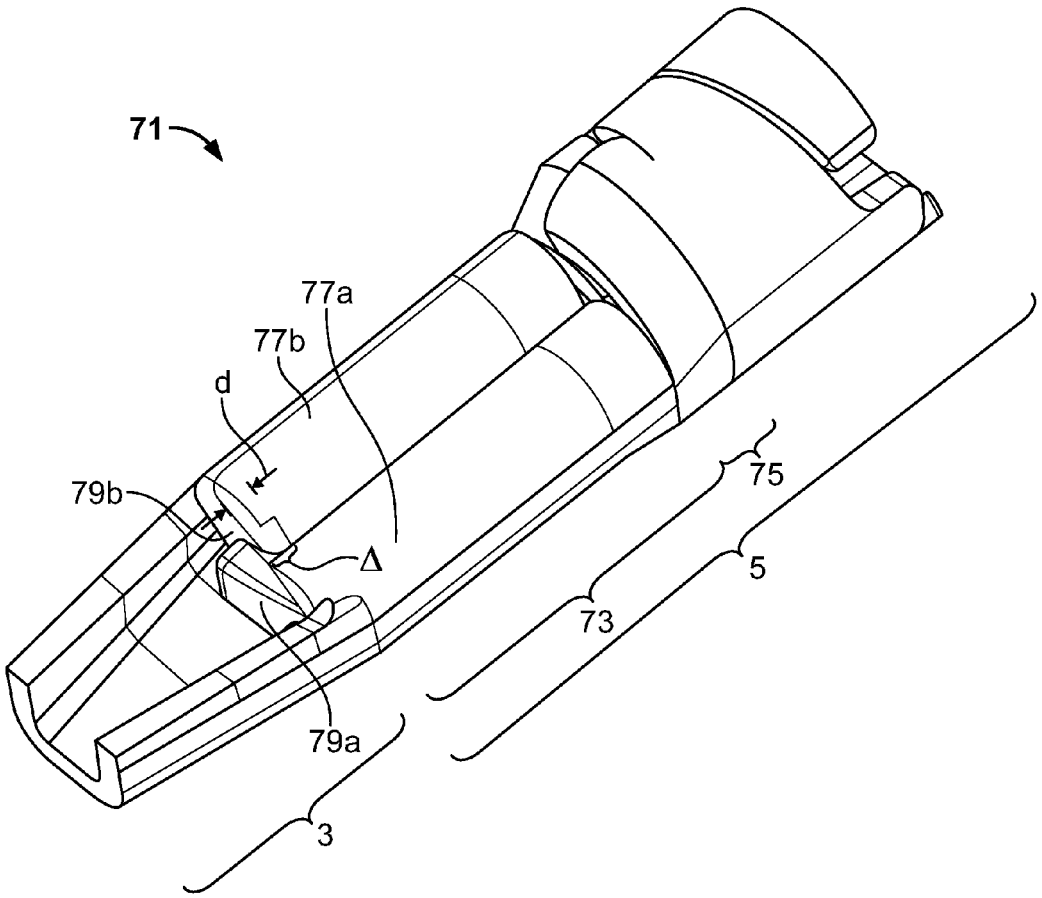
FIG. 4 is a perspective view of an electrical terminal.

In a second embodiment of FIG. 4, an electrical terminal 71 is shown. Elements showing the same reference numerals as already used in the first embodiment and FIGS. 1, 2*a*, 2*b*, and 3*a* to 3*c* will not be described in detail again, but reference is made to their description above.

The second embodiment has a modified conductor receiving region 73 in the crimping portion 5 compared to the connector in the first embodiment. As shown in FIG. 4, one of the sidewalls 77*a* in the conductor receiving region 73 has a greater length towards the contacting portion 3 along the longitudinal axis than the opposing sidewall 77*b*.

Similar to the first embodiment, two front covers 79*a* and 79*b* are used to close the opening of the tunnel created by the folded sidewalls 77*a* and 77*b* of the conductor receiving region 73, in the crimped state. The sidewall 77*a* is longer by a distance Δ, essentially corresponding to the thickness d of the front cover 79*b*. As shown in FIG. 4, the front cover end 79*a* overlaps with the front cover end 79*b* to reliably seal away the internal volume of the tunnel from the exterior environment.

In an embodiment, voids inside the tunnel along the conductor receiving region 9 or 73 and the transition region 13 or 75 are filled with a corrosion protection material, such as grease or other similar moisture repellent or inhibitor, to even further reduce the risk of an exposure of the contact area to moisture.

Figure 5:
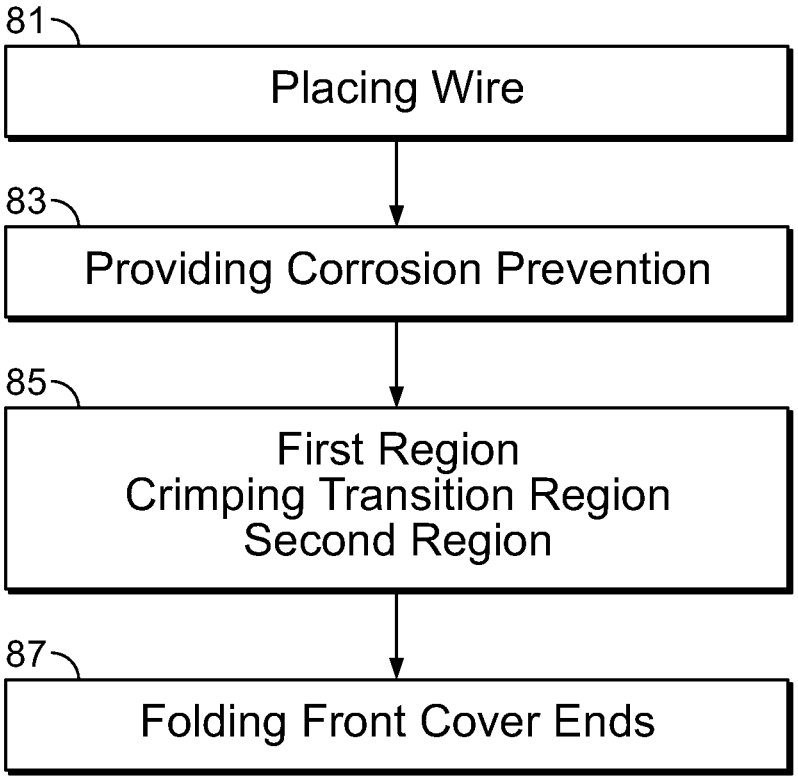
FIG. 5 is a block diagram of a method for fabricating the electrical terminal.

In FIG. 5, a block diagram describes an embodiment of fabricating an electrical connector as described in the above embodiments. The method can be realised in a complete automated way.

In a first step 81, a wire 33 is placed on the electrical terminal 1 or 71. The bare, stripped conductors 35 are positioned in the conductor receiving region 9 or 73 and the portion of the wire 33 having the insulation 37 is positioned in the wire insulation receiving region 11 so that the transition between the two parts of the wire 33 is positioned in the transition region 13 or 75.

In a second step 83, a corrosion preventing material is provided, such as grease, in the conductor receiving region 9 or 73 and the transition region 13 or 75.

In a third step 85, the sidewalls 19*a/b*, 21*a/b*, 23*a/b* in the conductor receiving region 9 or 75, the transition region 13 or 75 and the wire insulation receiving regions 11 are crimped to thereby enclose the wire 33 in the electrical terminal 1 or 711. Crimping in the conductor receiving region 9 is performed such that an F-crimp is achieved. Crimping of the transition region 13 or 75 is performed such that the end portions 45*a*,45*b* of the sidewalls 23*a*,23*b* are overlapping in the circumferential direction 47. Crimping of the wire insulation receiving region 11 is carried out such that the sidewalls are enveloping the insulation 37 without, however, having the overlapping ends.

Finally, according to step 87, the front covers 25*a*,25*b* are folded along the axis 69 perpendicular to the longitudinal axis 55 to close the tunnel formed by the crimped sidewalls.

What is claimed is:

1. An electrical terminal, comprising a crimp barrel having:

a base;

opposing side walls extending from the base and each having an opposing end region, the opposing side walls having a conductor receiving region in which the sidewalls have an F-crimp when crimped to a conductor of a wire, one of the sidewalls in the conductor receiving region extending a first distance along a length of the base that is greater than a second distance of the opposing sidewall along the length of the base, a wire insulation receiving region for receiving an insulation covered portion of the wire, and a transition region positioned between the conductor receiving region and the wire insulation receiving region, the opposing end regions in the transition region being overlapped in the circumferential direction when crimped to surround the wire; and one or more bendable front cover ends positioned at a first end of the conductor receiving region and crimped to overlap and close the first end, the first end opposite to a second end of the conductor receiving region adjacent to the transition region.

2. The electrical terminal of claim 1, wherein the base, the side walls of the conductor receiving region, and the side walls of the transition region define a tunnel having a confined volume when crimped.

3. The electrical terminal of claim 1, wherein, when crimped, the base and the sidewalls of the wire insulation receiving region have a non-overlapping open or closed ring shape.

4. The electrical terminal of claim 3, wherein, when crimped, the side walls of the wire insulation receiving region also form a tunnel at least partially adjacent the transition region.

5. The electrical terminal of claim 1, wherein, when crimped, the transition region has a funnel shape.

6. The electrical terminal of claim 1, wherein the first distance is approximately equal to a thickness of the front cover end.

7. The electrical terminal of claim 1, wherein an intersection between the sidewalls of the conductor receiving region and the sidewalls of the transition region has a cut in an edge region.

8. The electrical terminal of claim 1, wherein an intersection between the sidewalls of the transition region and the sidewalls of the wire insulation receiving region has a cut in an edge region.

9. An electrical connector comprising:

an electrical terminal having a crimp barrel with a base, opposing side walls extending from the base and each having an opposing end region, the opposing side walls having a conductor receiving region in which the sidewalls have an F-crimp when crimped to a conductor of a wire, one of the sidewalls in the conductor receiving region extending a first distance along a length of the base that is greater than a second distance of the opposing sidewall along the length of the base, a wire insulation receiving region for receiving an insulation covered portion of the wire, and a transition region positioned between the conductor receiving region and the wire insulation receiving region, the opposing end regions in the transition region being overlapped in the circumferential direction when crimped to surround the wire, and one or more bendable front cover ends positioned at a first end of the conductor receiving region and crimped to overlap and close the first end, the first end opposite to a second end of the conductor receiving region adjacent to the transition region; and a wire crimped in the crimp barrel.

10. The electrical connector of claim 9, further comprising a corrosion prevention material filling voids inside at least the conductor receiving region and the transition region of the crimp barrel.

11. The electrical connector of claim 9, wherein the wire is made of aluminum and the crimp barrel is made of copper.

12. A method for preparing an electrical connector, comprising the steps of introducing a wire in a crimp barrel having a base such that bare conductors of the wire are positioned in a conductor receiving region and an insulation covered portion of the wire is positioned in a wire insulation receiving region with the transition between the bare conductors and insulation being in a transition region;

folding the sidewalls of the conductor receiving region to form an F-crimp over the bare conductors, one of the sidewalls in the conductor receiving region extending a first distance along a length of the base that is greater than a second distance of the opposing sidewall along the length of the base;

folding the sidewalls of the transition region to form an overlapping crimp along a circumferential direction of the wire; and folding the sidewalls of the wire insulation receiving region to form a closed or open non-overlapping ring shape.

13. The method according to claim 12, further comprising the step of:

folding front cover ends of the sidewalls of the conductor receiving region to seal the conductor inside a tunnel formed by the sidewalls of the conductor receiving region and the transition region.

* * * * *